US006108818A

United States Patent [19]

Eisenberg

[11] Patent Number: 6,108,818

[45] Date of Patent: Aug. 29, 2000

[54] SKIN ADHERENT SWEAT BAND

[76] Inventor: Howard M. Eisenberg, 428 SW. Colony Dr., Portland, Oreg. 97219

[21] Appl. No.: 09/387,648

[22] Filed: Sep. 1, 1999

Related U.S. Application Data

[60] Provisional application No. 60/099,163, Sep. 4, 1998.

[51] Int. Cl.[7] ..... A42B 1/00

[52] U.S. Cl. ..... 2/181.2; 2/181.4; 2/DIG. 11

[58] Field of Search ..... 2/181.2, 181, 181.6, 2/181.4, 181.8, DIG. 11, 174, 170

[56] References Cited

U.S. PATENT DOCUMENTS

| | | | |
|---|---|---|---|
| 4,082,705 | 4/1978 | Beede et al. | 260/4 R |
| 4,308,623 | 1/1982 | Voorhees | 2/174 |
| 4,521,922 | 6/1985 | Mitchell et al. | 2/171 |
| 4,745,916 | 5/1988 | Seber | 128/155 |
| 5,033,122 | 7/1991 | Smith | 2/209.3 |
| 5,317,761 | 6/1994 | Piche | 2/181 |
| 5,331,686 | 7/1994 | Marshall | 2/181 |
| 5,553,326 | 9/1996 | Moore | 2/181 |
| 5,566,395 | 10/1996 | Nebecker | 2/181 |
| 5,633,070 | 5/1997 | Murayama et al. | 428/194 |

*Primary Examiner*—Bibhu Mohanty
*Attorney, Agent, or Firm*—Howard Eisenberg, Esq.

[57] ABSTRACT

A novel sweat band absorbs perspiration on the forehead, permits unrestricted air flow to portions of the head other than the forehead, and does not dishevel the wearer's hair. The sweat band secures to a person's head in a manner other than encircling the head or securing to or being part of an article which encircles or rests upon the head, preferably by adhering to the forehead. When worn, the sweat band preferably is positioned on the forehead and does not contact the wearer's hair on the sides of the forehead.

10 Claims, 2 Drawing Sheets

SKIN ADHERENT SWEAT BAND

This application claims the benefit of the priority of pending U.S. Provisional Application 60/099,163, filed Sep. 4, 1998.

FIELD OF THE INVENTION

The invention relates to perspiration absorbent articles, and particularly to sweat bands to absorb perspiration on the forehead.

BACKGROUND OF THE INVENTION

The use of sweat bands to absorb and control the flow of perspiration on the forehead has long been known. Sweat bands generally provide an elongated absorbent material that encircles the head at the level of the forehead. Such sweat bands have the disadvantage that they cover the hair at the temples and the back of the head. In doing so, the sweat band packs down the hair, causing a reduction in air flow to the head that results in decreased convective cooling and causing a disruption in the groomed appearance of the wearer's hair, commonly known as "hat hair".

Various modifications have been made to sweat bands to increase their effectiveness and comfort. U.S. Pat. No. 5,033,122 discloses a laminated sweat band which is disposable and biodegradable. U.S. Pat. No. 5,331,686 discloses a sweat band which contains an elastic strip along its surface to pucker the sweat band and provide tension while in place on the forehead. U.S. Pat. Nos. 4,521,922 and 5,745,921 disclose sweat bands which wick perspiration to the side of the user's head to prevent excess perspiration from dripping into the eyes. The sweat bands of each of these patents are secured in place on the forehead by encircling the head of the user. U.S. Pat. Nos. 4,630,317 and 5,553,326 disclose sweat bands that secure to the internal surface of a hat which is worn on the user's head. The sweat band of U.S. Pat. No. 5,553,326 does not completely encircle the user's head, but attaches to the liner of a hard hat. The liner, however, encircles the head and the hat covers the head.

SUMMARY OF THE INVENTION

The sweat band of the present invention can be used to absorb perspiration on the forehead but does not disrupt air flow to portions of the head other than the forehead and does not cause an unaesthetic packing of the wearer's hair.

The sweat band of the present invention is a stand-alone head band which secures to a person's head in a manner other than encircling the head or securing to or being part of an article which encircles or rests upon the head. The sweat band has one or more outer layers of an absorbent material and an inner layer of an adhesive in laminate contact with the innermost layer of the absorbent material. The sweat band is elongate, preferably rectangular or substantially rectangular in shape, and is designed to be used by applying the inner adhesive layer to the forehead with the outer absorbent layer being distant from the skin surface. Because the sweat band does not encircle the head, the sweat band does not interfere with free passage of air to regions of the head other than the region of the forehead covered by the sweat band. Additionally, when in place on the forehead, the sweat band does not dishevel the hair of the user.

Preferably, the inner adhesive layer of the sweat band is incomplete. That is, the innermost layer of absorbent material protrudes through portions of the adhesive layer, permitting direct contact of the forehead and the absorbent layer and, therefore, direct passage of perspiration from the portion of the forehead covered by the sweat band to the absorbent layer.

If desired, the sweat band may include an additional layer of a release paper in contact with the adhesive layer and distant from the outermost surface of the absorbent material. The release paper permits the sweat band to be stored without adhering to other objects and is to be removed before application of the sweat band to the forehead.

BRIEF DESCRIPTION OF THE DRAWINGS

FIG. 5 shows complete coverage of the inner surface of the sweat band with adhesive. FIGS. 6 to 10 show incomplete presence of adhesive on the inner surface. FIG. 8 is a preferred pattern of adhesive in which the adhesive is present in a dot pattern on the inner surface of the sweat band.

DETAILED DESCRIPTION OF THE PREFERRED EMBODIMENT OF THE INVENTION

Figure 1:
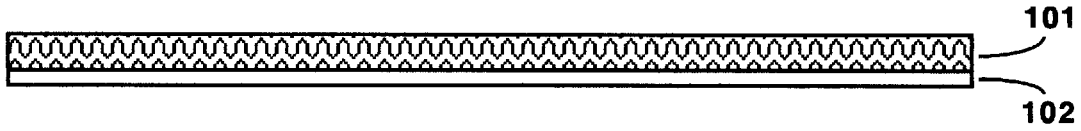
FIG. 1 shows the sweat band of the invention with two layers, an outer absorbent layer and an inner adhesive layer.
Figure 2:
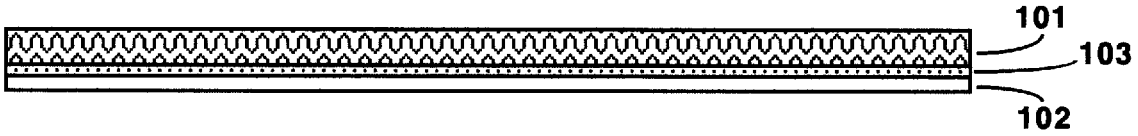
FIG. 2 shows the sweat band of the invention with three layers, an outer absorbent layer, an intermediate layer, and an inner adhesive layer.
Figure 3:
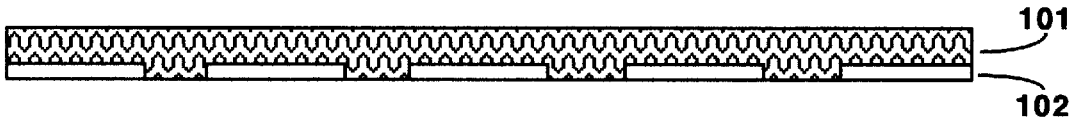
FIG. 3 shows a two layer sweat band of the invention in which the inner adhesive layer is incomplete and the outer absorbent layer extends through the adhesive.
Figure 4:
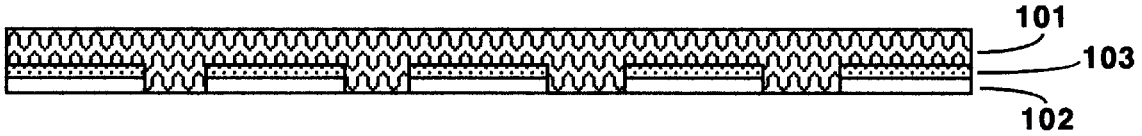
FIG. 4 shows a three layer sweat band of the invention in which the intermediate layer and the inner adhesive layer are incomplete and the outer absorbent layer extends through the inner two layers.

In a preferred embodiment, the sweat band of the invention is a head band which is secured to the skin of the forehead by an adhesive. When worn, the sweat band only partially encircles the head, typically positioned on the anterior portion of the forehead between the temples. As shown in FIGS. 1 to 4, the sweat band contains one or more layers of a perspiration absorbent material 101 and a layer of an adhesive 102. The sweat band may further include one or more intermediate layers 103, such as tape, between the absorbent material 101 and the adhesive 102. In a preferred embodiment, portions of the absorbent material 101 protrude through the adhesive layer 102 and, if present, the intermediate layer 103.

The sweat band is flattened and preferably elongate to cover the majority of the surface of the forehead of the user. Preferably, the sweat band is substantially rectangular in shape having a length between about 5 cm to about 15 cm and a width between about 1 cm to about 7.5 cm. If desired, the edges along the length and/or the width of the sweat band may be convex or concave, or may be undulating. Other dimensions may be used for the sweat band of the invention without affecting the scope of the invention so long as the sweat band is not so long that it encircles the user's head, and preferably not so long that it contacts the hair at the temples, and is not so wide that it interferes with the user's eyes, and preferably does not contact the eyebrows.

In one embodiment, the sweat band of the invention has a rectangular portion that covers the forehead, and one or two sidebars that extend downward on the sides of the wearer's face between the eyes and the hairline and may extend down to the level of the nose or the mouth.

If desired, portions of the sweat band may be cut out to form patterns and/or the sweat band may be in an irregular decorative shape, such as in the shape of a star. Such embodiments are considered to be within the scope of the present invention.

The absorbent material may be any natural or synthetic material which will absorb perspiration. Woven and non-woven fabrics are suitable. Examples of suitable natural materials include cotton fabrics like terry cloth or flannel and pulp based fabrics. Suitable synthetic materials include fabrics of rayon, polyesters, polypropylenes, synthetic or natural sponge, or coform, a combination of meltblown polymers and absorbent staple fibers such as cellulose. Combinations or blends of natural and/or synthetic materials may be used. Laminated absorbent articles, such as those used in disposable diapers and feminine hygiene articles, are also suitable for the absorbent material layer or layers.

A suitable adhesive is one which will bind to the absorbent material and to skin. Alternatively, one or more intermediate layers, such as a tape, may be situated between the absorbent material and the adhesive. In this case, the adhesive between the tape and the innermost surface of the sweat band must bind to the tape and to skin. The intermediate layer may be secured to the absorbent material by the same or a different adhesive as between the intermediate layer and the skin, or may be bound to the absorbent material by other means, such as by stitching.

Preferably, the skin binding adhesive is a pressure sensitive adhesive that is hypo-allergenic, non-toxic, non-irritating to skin, adherent to skin when exposed to perspiration, readily removable from skin, and has a sufficient internal strength so that it will leave minimal adhesive residue on the skin when the sweat band is removed. The adhesive may or may not be perspiration permeable. Examples of suitable adhesives include acrylate, polyolefin-based, polyurethane, natural or synthetic rubber polymer, silicone, and styrene-isoprene-styrene block pressure sensitive adhesives. A suitable adhesive is a hydrocolloid skin protective adhesive disclosed in U.S. Pat. No. 5,633,010, and manufactured by 3M Company (Minneapolis, Minn.). Examples of other suitable adhesives are disclosed in U.S. Pat. Nos. 5,536,768, 5,665,477, 4,140,115, 4,925,671, and 4,082,705.

Figure 5:
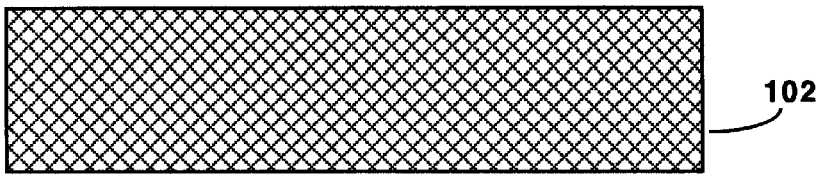
FIGS. 5 to 10 show inner-layer views of the sweat band of the invention with several preferred patterns of the adhesive and the absorbent material on the inner surface of the sweat band.
Figure 6:
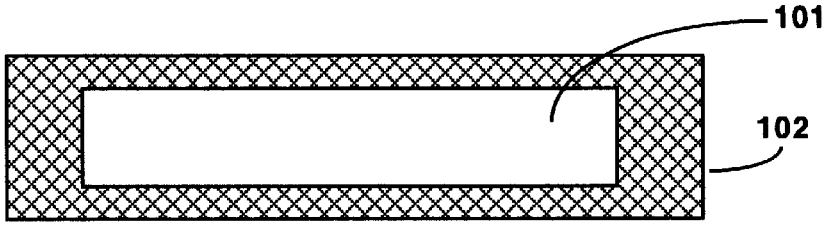
Figure 7:
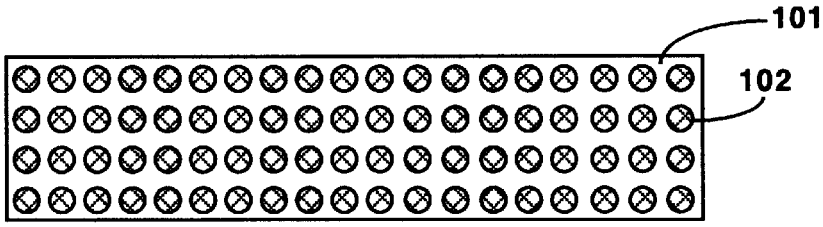
Figure 8:
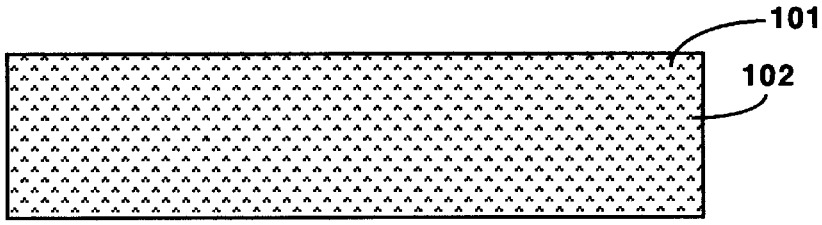
Figure 9:
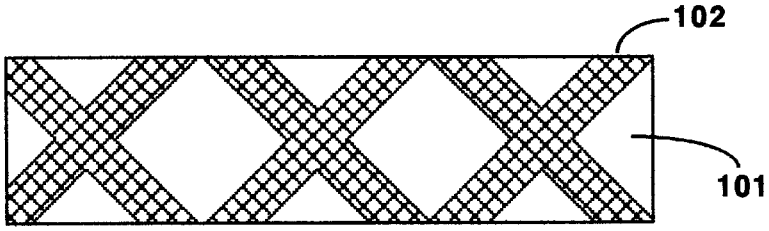
Figure 10:
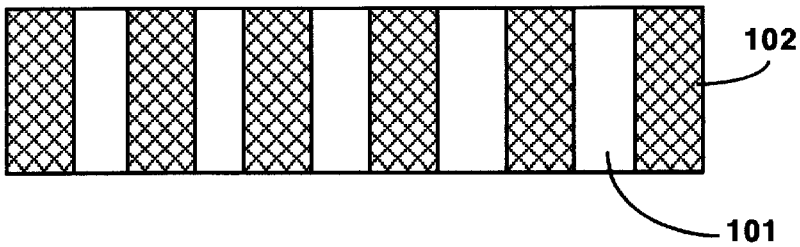

Preferably, the skin adhesive is not coated on the absorbent material, but rather intermittently covers the inner surface of the absorbent material so that, when the sweat band is worn, portions of the absorbent material are in direct contact with the skin surface. FIGS. 5 to 10 show several preferred patterns of adhesive 103 position which permit direct contact of the absorbent material 102 and the skin. This incomplete coverage permits the passage of perspiration to the absorbent layer from the underlying forehead and permits the skin of the forehead to move beneath the sweat band.

Any additional layer situated between the absorbent layer and the skin adhesive layer should preferably not interfere with absorption of perspiration by the absorptive layer of the sweat band. This may be achieved by employing a perspiration permeable tape for this intermediate layer or by positioning the intermediate layer only in areas where there is skin adhesive, wherein the skin adhesive is in a pattern which permits passage of perspiration from the forehead to the inner surface of the absorbent material. See examples of such patterns in FIGS. 5 to 10.

In a preferred embodiment, the sweat band is mounted for pre-use purposes on a release paper in contact with the adhesive of the sweat band. Any release paper is suitable for the sweat band of the invention, such as wax paper or silicone release paper.

The sweat band of the invention may be made by a variety of methods well known in the art. For example, the adhesive may be applied directly to the absorbent material by brushing, spraying, rolling, or pattern-coating. Alternatively, a skin-adhesive tape may be adhered or stitched to the absorbent material.

Each of the US Patents cited in this specification is incorporated herein by reference.

Many modifications and variations of the present invention as described and claimed herein may be apparent to those skilled in the art. It is intended that these modifications and variations be embodied in the following claims.

What is claimed is:

1. A method for absorbing perspiration from the forehead comprising obtaining a head band comprising a perspiration absorbing fabric having internal and external surfaces and an adhesive bound to said internal surface and adhesively securing said internal surface of said head band to said forehead.

2. The method of claim 1 wherein said adhesive is non-toxic, hypo-ailergenic, and non-irritating to skin.

3. The method of claim 2 wherein said head band remains bonded to said forehead in the presence of perspiration.

4. The method of claim 2 wherein a portion of the perspiration absorbing fabric contacts said forehead when said head band is secured.

5. A method for securing a head band to the forehead of a user comprising obtaining a head band comprising a perspiration absorbing fabric having external and internal surfaces and a non-toxic, hypoallergenic, and non-irritating adhesive bound to said internal surface of the fabric, and adhesively securing said head band directly to said forehead.

6. The method of claim 5 wherein a portion of said fabric is in contact with said forehead when the head band is secured.

7. The method of claim 1 wherein the adhesive is a pressure sensitive adhesive.

8. The method of claim 7 wherein the adhesive is selected from the group consisting of acrylate, polyolefin-based, polyurethane, natural or synthetic rubber polymer, silicone, styrene-isoprene-styrene block, and hydrocolloid pressure sensitive adhesives.

9. The method of claim 5 wherein the adhesive is a pressure sensitive adhesive.

10. The method of claim 9 wherein the adhesive is selected from the group consisting of acrylate, polyolefin-based, polyurethane, natural or synthetic rubber polymer, silicone, styrene-isoprene-styrene block, and hydrocolloid pressure sensitive adhesives.

* * * * *